US010415125B2

(12) United States Patent
Arai et al.

(10) Patent No.: US 10,415,125 B2
(45) Date of Patent: Sep. 17, 2019

(54) THICK-WALL OIL-WELL STEEL PIPE AND PRODUCTION METHOD THEREOF

(71) Applicant: NIPPON STEEL & SUMITOMO METAL CORPORATION, Tokyo (JP)

(72) Inventors: Yuji Arai, Amagasaki (JP); Keiichi Kondo, Izumisano (JP); Koji Nagahashi, Wakayama (JP)

(73) Assignee: NIPPON STEEL CORPORATION, Tokyo (JP)

( * ) Notice: Subject to any disclaimer, the term of this patent is extended or adjusted under 35 U.S.C. 154(b) by 304 days.

(21) Appl. No.: 15/505,678

(22) PCT Filed: Aug. 31, 2015

(86) PCT No.: PCT/JP2015/004403

§ 371 (c)(1),
(2) Date: Feb. 22, 2017

(87) PCT Pub. No.: WO2016/035316

PCT Pub. Date: Mar. 10, 2016

(65) Prior Publication Data

US 2017/0292177 A1 Oct. 12, 2017

(30) Foreign Application Priority Data

Sep. 4, 2014 (JP) ..... 2014-180568

(51) Int. Cl.

| | |
|---|---|
| ***C22C 38/44*** | (2006.01) |
| ***C22C 38/18*** | (2006.01) |
| ***C22C 38/02*** | (2006.01) |
| ***C22C 38/04*** | (2006.01) |
| ***C22C 38/06*** | (2006.01) |

(Continued)

(52) U.S. Cl.

CPC ..... *C22C 38/44* (2013.01); *C21D 6/004* (2013.01); *C21D 9/08* (2013.01); *C21D 9/085* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/46* (2013.01);

(Continued)

(58) Field of Classification Search

None

See application file for complete search history.

(56) References Cited

FOREIGN PATENT DOCUMENTS

| | | |
|---|---|---|
| CA | 2 857 439 | 6/2013 |
| EA | 200870437 | 2/2009 |

(Continued)

*Primary Examiner* — Xiaowei Su

(74) *Attorney, Agent, or Firm* — Clark & Brody

(57) ABSTRACT

A thick-wall oil-well steel pipe has a wall thickness of 40 mm or more, excellent SSC resistance and high strength. The thick-wall oil-well steel pipe has a composition containing, in mass %, C: 0.40 to 0.65%, Si: 0.05 to 0.50%, Mn: 0.10 to 1.0%, P: 0.020% or less, S: 0.0020% or less, sol. Al: 0.005 to 0.10%, Cr more than 0.40 to 2.0%, Mo: more than 1.15 to 5.0%, Cu: 0.50% or less, Ni: 0.50% or less, N: 0.007% or less, and O: 0.005% or less. The number of carbide which has a circle equivalent diameter of 100 nm or more and contains 20 mass % or more of Mo is 2 or less per 100 $mm^2$. The thick-wall oil-well steel pipe has yield strength of 827 MPa or more. A difference between a maximum value and a minimum value of the yield strength in the wall-thickness direction is 45 MPa or less.

2 Claims, 6 Drawing Sheets

(51) Int. Cl.

| | |
|---|---|
| ***C21D 9/08*** | (2006.01) |
| ***C22C 38/00*** | (2006.01) |
| ***C22C 38/54*** | (2006.01) |
| ***C21D 6/00*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/48* (2013.01); *C22C 38/50* (2013.01); *C22C 38/54* (2013.01)

(56) References Cited

FOREIGN PATENT DOCUMENTS

| | | |
|---|---|---|
| EP | 2749664 | 7/2014 |
| JP | 59-232220 | 12/1984 |
| JP | 62-253720 | 11/1987 |
| JP | 2006-265657 | 10/2006 |
| JP | 5333700 | 11/2013 |
| WO | 2013/133076 | 9/2013 |
| WO | 2013/191131 | 12/2013 |

BRIGHT-FIELD IMAGE

THICK-WALL OIL-WELL STEEL PIPE AND PRODUCTION METHOD THEREOF

TECHNICAL FIELD

The present invention relates to an oil-well steel pipe and a production method thereof, and more particularly to a thick-wall oil-well steel pipe having a wall thickness of 40 mm or more, and a production method thereof.

BACKGROUND ART

As oil wells and gas wells (hereinafter, oil wells and gas wells are collectively referred to as "oil wells") become deeper, higher strength is required for oil-well steel pipes. Conventionally, oil-well steel pipes of 80 ksi grade (yield strength is 80 to 95 ksi, that is, 551 to 654 MPa), and of 95 ksi grade (yield strength is 95 to 110 ksi, that is, 654 to 758 MPa) have been widely used. However, in recent years, oil-well steel pipes of 110 ksi grade (yield strength is 110 to 125 ksi, that is, 758 to 862 MPa) have been started to be used.

Many of deep wells contain hydrogen sulfide which has corrosiveness. For that reason, an oil-well steel pipe for use in deep wells is required to have not only high strength but also sulfide stress cracking resistance (hereinafter referred to as SSC resistance).

Conventionally, as a measure to improve the SSC resistance of an oil-well steel pipe of 95 to 110 ksi classes, there is known a method of cleaning steel or refining steel structure. In the case of the steel proposed in Japanese Patent Application Publication No. 62-253720 (Patent Literature 1), impurities such as Mn and P are reduced to increase the level of cleanliness of steel, thereby improving the SSC resistance of steel. The steel proposed in Japanese Patent Application Publication No. 59-232220 (Patent Literature 2) is subjected to quenching twice to refine crystal grains, thereby improving the SSC resistance of steel.

However, the SSC resistance of steel material significantly deteriorates as the strength of steel material increases. Therefore, for practical oil-well steel pipes, a stable production of an oil-well pipe of 120 ksi class (yield strength is 827 MPa or more) having the SSC resistance which can endure the standard condition (1 atm $H_2S$ environment) of the constant load test of NACE TM0177 method A has not been realized yet.

Under the background described above, an attempt has been made to use high-C low alloy steel having a C content of 0.35% or more, which has not been put into practical use, as an oil-well pipe to achieve high strength.

The oil-well steel pipe disclosed in Japanese Patent Application Publication No. 2006-265657 (Patent Literature 3) is produced by subjecting low alloy steel containing C: 0.30 to 0.60%, Cr+Mo: 1.5 to 3.0% (Mo is 0.5% or more), and others to tempering after oil-cooling quenching or austempering. This literature describes that the above described production method allows to suppress quench cracking which is likely to occur during quenching of high-C low alloy steel, thereby to obtain an oil-well steel or oil-well steel pipe, which has excellent SSC resistance.

The oil-well steel disclosed in Japanese Patent No. 5333700 (Patent Literature 4) contains C: 0.56 to 1.00% and Mo: 0.40 to 1.00%, and exhibits not more than 0.50 deg of a half-peak width of (211) crystal plane obtained by X-ray diffractometry, and yield strength of 862 MPa or more. This literature describes that SSC resistance is improved by spheroidizing of grain boundary carbides, and the spheroidizing of carbides during high temperature tempering is further facilitated by increasing the C content. Patent Literature 4 also proposes a method of limiting a cooling rate during quenching, or temporarily stopping cooling during quenching and performing isothermal treatment to hold in a range of more than 100° C. to 300° C., in order to suppress quench cracking attributable to a high-C alloy.

The steel for oil-well pipe disclosed in International Application Publication No. WO2013/191131 (Patent Literature 5) contains C: more than 0.35% to 1.00%, Mo: more than 1.0% to 10%, and others in which the product of C content and Mo content is 0.6 or more. Further in the above described steel for oil-well pipe, the number of $M_2C$ carbide which has a circle equivalent diameter of 1 nm or more, and has a hexagonal structure is 5 or more per 1 $\mu m^2$, and the half-peak width of the (211) crystal plane and the C concentration satisfy a specific relationship. In addition, the above described steel for oil-well pipe has yield strength of 758 MPa or more. In Patent Literature 5, a quenching method similar to that in Patent Literature 4 is adopted.

However, even with the techniques of Patent Literatures 3 to 5, it is difficult to obtain excellent SSC resistance and high strength in a thick-wall oil-well steel pipe, more specifically in an oil-well steel pipe having a wall thickness of 40 mm or more. In particular, in a thick-wall oil-well steel pipe, it is difficult to obtain high strength and reduced variation in strength in the wall-thickness direction.

SUMMARY OF INVENTION

It is an object of the present invention to provide a thick-wall oil-well steel pipe which has a wall thickness of 40 mm or more, and has excellent SSC resistance and high strength (827 MPa or more), in which variation in strength in the wall-thickness direction is small.

A thick-wall oil-well steel pipe according to the present invention has a wall thickness of 40 mm or more. The thick-wall oil-well steel pipe has a chemical composition consisting of, in mass %, C: 0.40 to 0.65%, Si: 0.05 to 0.50%, Mn: 0.10 to 1.0%, P: 0.020% or less, S: 0.0020% or less, sol. Al: 0.005 to 0.10%, Cr: more than 0.40 to 2.0%, Mo: more than 1.15 to 5.0%, Cu: 0.50% or less, Ni: 0.50% or less, N: 0.007% or less, O: 0.005% or less, V: 0 to 0.25%, Nb: 0 to 0.10%, Ti: 0 to 0.05%, Zr: 0 to 0.10%, W: 0 to 1.5%, B: 0 to 0.005%, Ca: 0 to 0.003%, Mg: 0 to 0.003%, and rare earth metals: 0 to 0.003%, with the balance being Fe and impurities. Further, a number of carbide which has a circle equivalent diameter of 100 nm or more and contains 20 mass % or more of Mo is 2 or less per 100 $\mu m^2$. Furthermore, the above described thick-wall oil-well steel pipe has yield strength of 827 MPa or more, and the difference between a maximum value and a minimum value of the yield strength in the wall-thickness direction is 45 MPa or less.

A method for producing a thick-wall oil-well steel pipe according to the present invention includes the steps of: producing a steel pipe having the above described chemical composition, subjecting the steel pipe to quenching once or multiple times, wherein a quenching temperature in the quenching of at least once is 925 to 1100° C., and subjecting the steel pipe to tempering after the quenching.

A thick-wall oil-well steel pipe according to the present invention, which has a wall thickness of 40 mm or more, has excellent SSC resistance and high strength (827 MPa or more), as well as reduced variation in strength in the wall-thickness direction.

BRIEF DESCRIPTION OF DRAWINGS

in FIG. 3.

DESCRIPTION OF EMBODIMENTS

Figure 1:
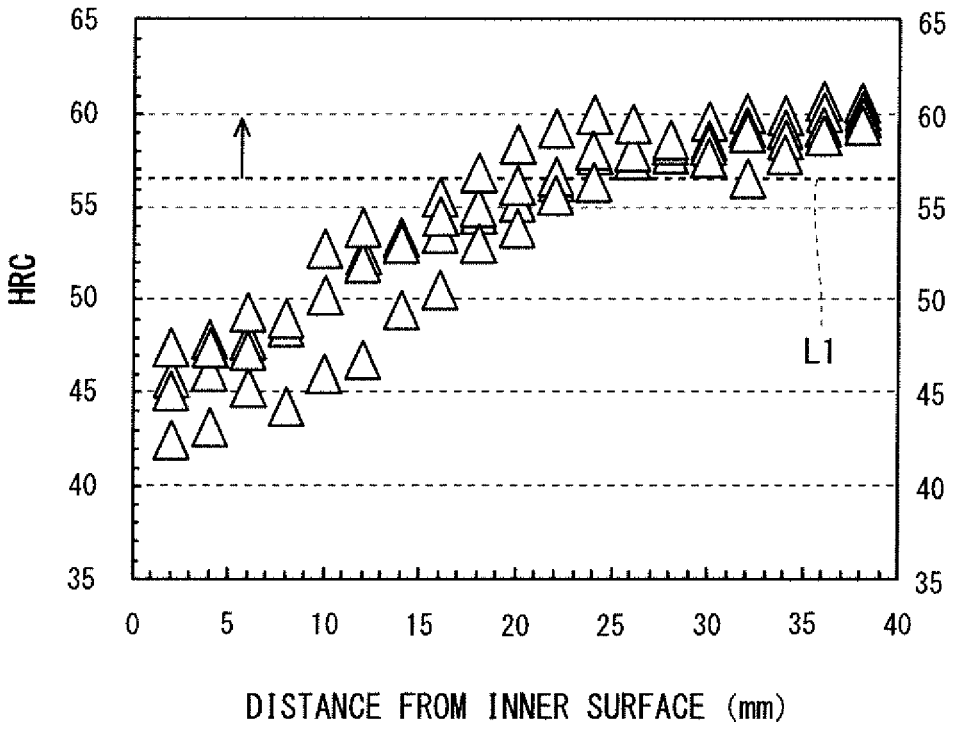
FIG. 1 illustrates Rockwell hardness (HRC) in a wall-thickness direction of a thick-wall oil-well steel pipe having a chemical composition shown in Table 1.

The present inventors have completed the present invention based on the following findings.

There is known a method of increasing Mn and Cr contents to ensure hardenability. However, increasing the contents of those elements will result in deterioration of SSC resistance. On the other hand, although C and Mo improve hardenability as well as Mn and Cr do, they will not deteriorate SSC resistance. Therefore, suppressing the Mn content to 1.0% or less and the Cr content to 2.0% or less, and instead making the C content 0.40% or more and the Mo content more than 1.15% will make it possible to improve hardenability while maintaining SSC resistance. Higher hardenability will result in increase in the strength of steel.

When the C content is 0.40% or more, carbides in steel are more likely to be spheroidized. As a result of that, SSC resistance will be improved. Further, it is possible to increase the strength of steel by precipitation strengthening of carbides.

In the case of an oil-well steel pipe having a normal thickness, adjusting the chemical composition as describe above will make it possible to improve SSC resistance and hardenability at the same time. However, in an oil-well steel pipe having a wall thickness of 40 mm or more, it is found that only adjusting the chemical composition cannot ensure satisfactory hardenability.

Under the circumstances, the present inventors have studied this problem. As a result, the following findings have been obtained.

In quenching, if quenching is performed with a carbide containing 20% or more in mass % of Mo (hereinafter referred to as a Mo carbide) being undissolved, hardenability will deteriorate. Specifically, when the Mo carbide is undissolved, hardenability will not be improved since Mo and C are not sufficiently dissolved into steel. Performing quenching in this state will only induce generation of bainite, and martensite is not likely to be generated.

Accordingly, a quenching temperature is set 925 to 1100° C. in the quenching of at least once among quenching to be performed once or multiple times. In this case, the Mo carbide will be dissolved sufficiently. As a result of that, hardenability of steel is significantly improved, yield strength can be made 827 MPa or more, and variation in yield strength (maximum value−minimum value) in the wall-thickness direction can be suppressed to 45 MPa or less. Hereinafter, detailed description will be made on this point.

A seamless steel pipe having a wall thickness of 40 mm and having the chemical composition shown in Table 1 was produced. The produced steel pipe was heated at a quenching temperature of 900° C. Thereafter, quenching is performed by applying mist cooling to the outer surface of the steel pipe.

TABLE 1

| Chemical composition (in mass %, and the balance being Fe and impurities) | | | | | | | | | | | | | | | |
|---|---|---|---|---|---|---|---|---|---|---|---|---|---|---|---|
| C | Si | Mn | P | S | Sol.Al | Cr | Mo | Cu | Ni | N | O | V | Nb | Ti | Ca |
| 0.51 | 0.26 | 0.44 | 0.006 | 0.0006 | 0.031 | 0.52 | 1.49 | 0.03 | 0.02 | 0.0062 | 0.0008 | 0.088 | 0.032 | 0.005 | 0.0003 |

Rockwell hardness (HRC) in the wall-thickness direction was measured in a section normal to the axis direction of the steel pipe after quenching. Specifically, Rockwell hardness (HRC) measurement test conforming to JIS Z2245 (2011) was performed in the above described section at 2 mm intervals from the inner surface toward the outer surface.

Measurement results are illustrated in FIG. 1. Referring to FIG. 1, a reference line L1 in FIG. 1 indicates HRCmin calculated from the following Formula (1) specified by API Specification 5CT.

$$HRC\ \text{min}=58\times C+27 \quad (1)$$

Formula (1) means Rockwell hardness at a lower limit in which the amount of martensite becomes 90% or more. In Formula (1), C means a C (carbon) content (mass %) of steel. To ensure SSC resistance required as an oil-well pipe, hardness after quenching is desirably not less than HRCmin specified by the above described Formula (1).

Referring to FIG. 1, Rockwell hardness significantly decreased from the outer surface toward the inner surface, and Rockwell hardness became less than HRCmin of Formula (1) in a range from the wall thickness center to the inner surface.

This steel pipe was subjected to tempering at various tempering temperatures. Then, a round bar tensile test specimen having a diameter of 6 mm and a parallel portion of 40 mm length was fabricated from each of a position of a 6 mm depth from the outer surface (referred to as an outer surface first position), a wall-thickness central position, and a position of a 6 mm depth from the inner surface (referred to as an inner surface first position) of the steel pipe after tempering. Using the fabricated tensile test specimens, tension test was performed at a normal temperature (25° C.) in the atmosphere to obtain yield strength (ksi).

Figure 2:
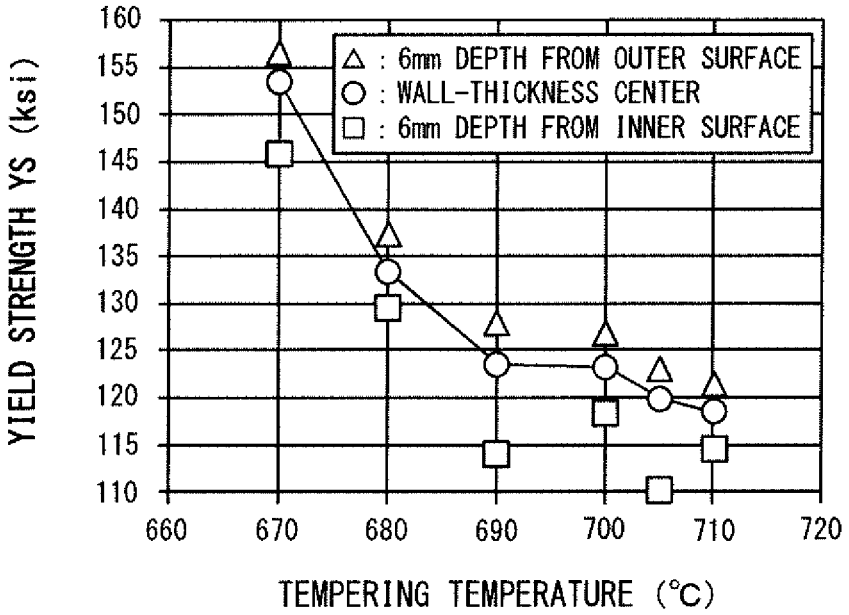
FIG. 2 illustrates a relationship between a tempering temperature for the thick-wall oil-well steel pipe having the chemical composition shown in Table 1, and yield strength in an outer surface portion, a wall-thickness central portion, and an inner surface portion of the thick-wall oil-well steel pipe.

FIG. 2 is a diagram to illustrate the relationship between tempering temperature (° C.) and yield strength YS. A triangle mark (Δ) in FIG. 2 indicates yield strength YS (ksi) at the outer surface first position. A circle mark (●) indicates yield strength YS (ksi) at the wall-thickness central position. A square mark (■) indicates yield strength YS (ksi) at the inner surface first position.

Referring to FIG. 2, the difference between the maximum value and the minimum value of yield strength at the outer surface first position, the wall-thickness central position, and the inner surface first position was large at any of tempering temperatures. That is, hardness (strength) variation generated during quenching was not resolved by tempering.

Figure 3:
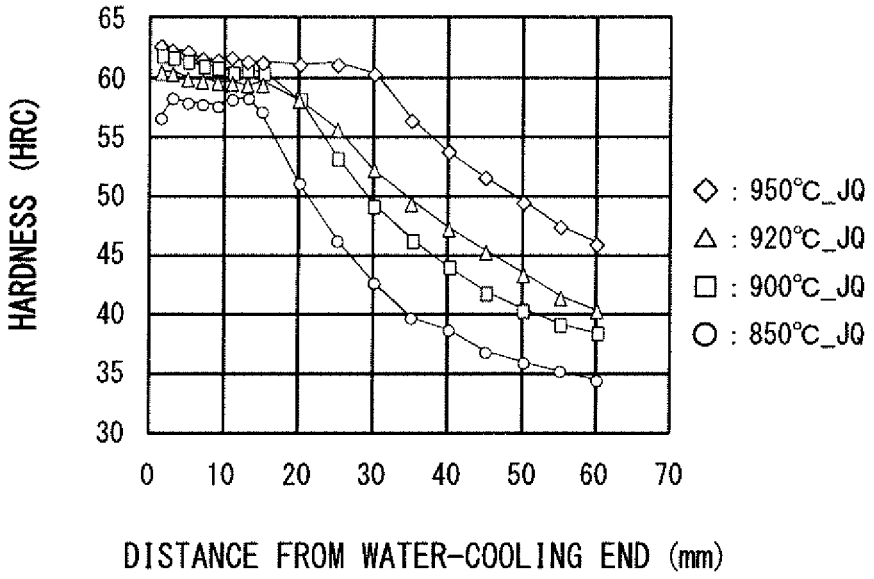
FIG. 3 illustrates Jominy test results of a steel material having the chemical composition shown in Table 1.

Then, to investigate the effect of quenching temperature, Jominy test conforming to JIS G0561 (2011) was performed using a steel material having the chemical composition of Table 1. FIG. 3 illustrates the Jominy test results.

A rhombus (◇) mark in FIG. 3 indicates a result at a quenching temperature of 950° C. A triangle (Δ) mark indicates a result at a quenching temperature of 920° C. A square (□) mark and a circle (○) mark indicate results at quenching temperatures of 900° C. and 850° C., respectively. Referring to FIG. 3, the effect of a quenching temperature on a quenching depth was significant in the case of steel having a high C content and Mo content. Specifically, when a quenching temperature was 950° C., Rockwell hardness was more than 60 HRC even at a distance of 30 mm from the water-cooling end, and thus excellent hardenability was recognized compared with the case in which a quenching temperature was less than 925° C.

Figure 4:
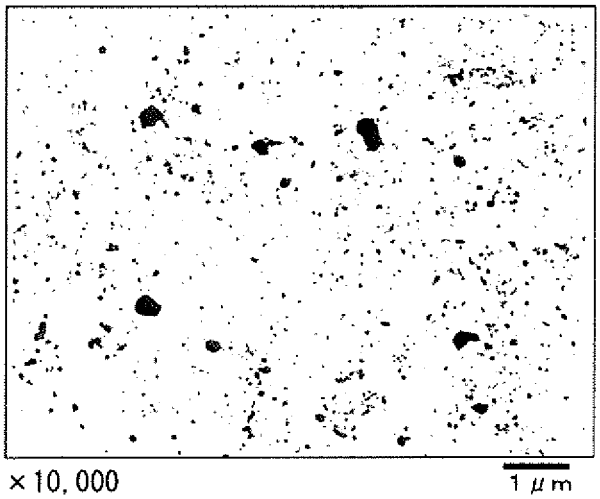
FIG. 4 is a transmission type electron microscope (TEM) image of a steel material subjected to quenching at a quenching temperature of 850° C.

Here, micro-structure observation of the steel material which had low hardenability and was subjected quenching at a temperature of 850° C., was performed. FIG. 4 illustrates a micro-structure photographic image (TEM image) of the steel material subjected to quenching at 850° C. Referring to FIG. 4, there were a large number of precipitates in the steel. As a result of performing Energy Dispersive X-ray Spectroscopy (EDX) on the precipitates, it was revealed that most of the precipitates were undissolved Mo carbides (carbides containing 20 mass % of Mo).

In order to determine whether or not the same tendency was observed in a high-C steel having a low Mo content, the following test was performed. A steel material having the chemical composition shown in Table 2 was prepared. The Mo content of this test specimen was 0.68% and lower than the Mo content in the chemical composition of Table 1.

Figure 6:
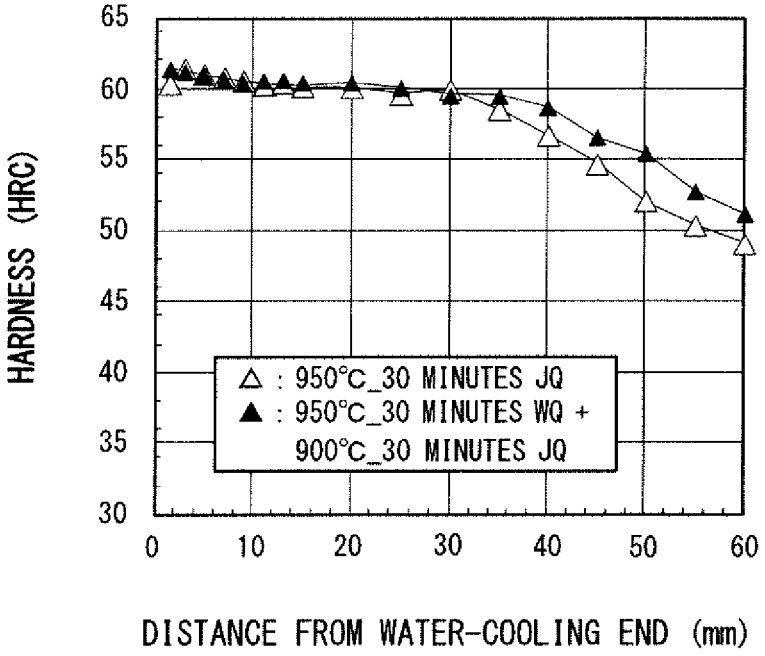
FIG. 6 illustrates Jominy test results when the number of quenching is varied using the steel material having the chemical composition shown in Table 1.

A black triangle (▲) mark in FIG. 6 illustrates a Jominy test result when quenching was performed two times, in which the quenching temperature was 950° C. and the soaking time was 30 minutes in the first quenching, and the quenching temperature was 900° C. and the soaking time was 30 minutes in the second quenching. A white triangle (Δ) mark in FIG. 6 illustrates a Jominy test result when only the first quenching was performed in which the quenching temperature was 950° C. and the soaking time was 30 minutes. Referring to FIG. 6, it is seen that when quenching is performed two times, hardenability will be improved if the quenching temperature in the quenching of at least once is 925° C. or more.

As described so far, if quenching is performed at a quenching temperature of 925° C. or more (hereinafter, referred to as high temperature quenching) for high-Mo, high-C low alloy steel, an undissolved Mo carbide will sufficiently dissolve, and thereby hardenability will be significantly improved. As a result of that, it is possible to obtain yield strength of 827 MPa or more and reduce the variation in yield strength in the wall-thickness direction. Further, it is also possible to improve SSC resistance since Cr content and Mn content can be suppressed.

A thick-wall oil-well steel pipe according to the present embodiment, which has been completed based on the above described findings, has a wall thickness of 40 mm or more. The thick-wall oil-well steel pipe has a chemical composition consisting of, in mass %, C: 0.40 to 0.65%, Si: 0.05 to 0.50%, Mn: 0.10 to 1.0%, P: 0.020% or less, S: 0.0020% or less, sol. Al: 0.005 to 0.10%, Cr: more than 0.40 to 2.0%, Mo: more than 1.15 to 5.0%, Cu: 0.50% or less, Ni: 0.50% or less, N: 0.007% or less, O: 0.005% or less, V: 0 to 0.25%, Nb: 0 to 0.10%, Ti: 0 to 0.05%, Zr: 0 to 0.10%, W: 0 to 1.5%, B: 0 to 0.005%, Ca: 0 to 0.003%, Mg: 0 to 0.003%, and rare earth metals: 0 to 0.003%, with the balance being Fe and impurities. Further, the number of carbide which has a circle equivalent diameter of 100 nm or more and contains 20 mass % or more of Mo is 2 or less per 100 $\mu m^2$. Further, the above described thick-wall oil-well steel pipe has yield strength of 827 MPa or more, in which the difference between a maximum value and a minimum value of the yield strength in the wall-thickness direction is 45 MPa or less.

TABLE 2

| Chemical composition (in mass %, and the balance being Fe and impurities) | | | | | | | | | | | | | | | | |
|---|---|---|---|---|---|---|---|---|---|---|---|---|---|---|---|---|
| C | Si | Mn | P | S | sol.Al | Cr | Ma | Cu | Ni | N | O | V | Nb | Ti | B | Ca |
| 0.53 | 0.27 | 0.43 | 0.001 | 0.001 | 0.029 | 0.52 | 0.68 | — | 0.02 | 0.0038 | 0.0009 | 0.088 | 0.031 | 0.006 | 0.0001 | 0.0002 |

Figure 5:
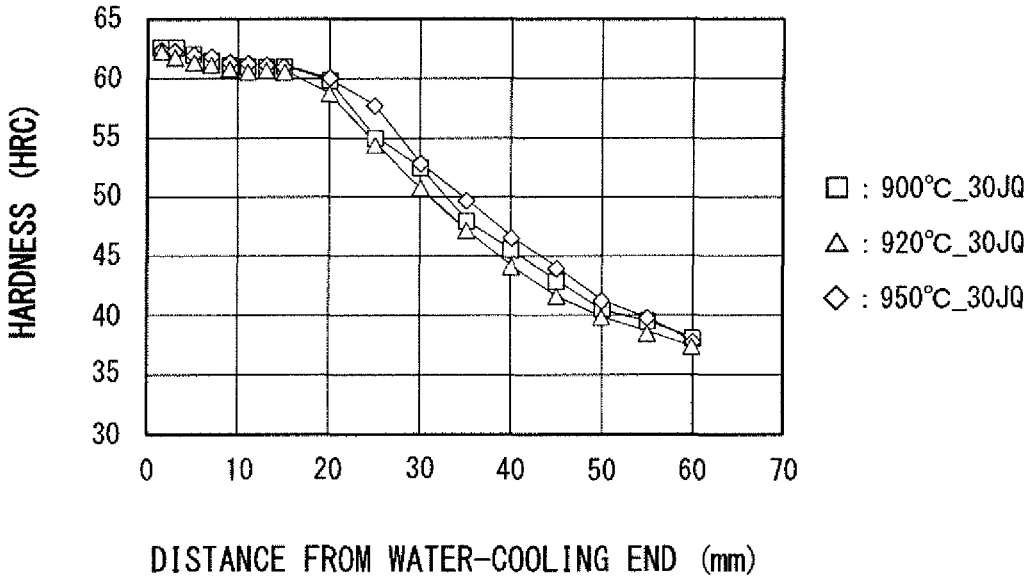
FIG. 5 illustrates Jominy test results of a steel material having the chemical composition shown in Table 2.

Jominy test conforming to JIS G0561 (2011) was performed using the steel material of Table 2. FIG. 5 illustrates the Jominy test results.

A rhombus (◇) mark in FIG. 5 indicates a result at a quenching temperature of 950° C. A triangle (Δ) mark and a square (□) mark indicate results at quenching temperatures of 920° C. and 900° C., respectively. Referring to FIG. 5, in the case of a low Mo content, there was observed no effect of a quenching temperature on the quenching depth. That is, it was found that the effect of the quenching temperature on the quenching depth was a phenomenon peculiar to high-Mo, high-C low alloy steel having a C content of 0.40% or more and a Mo content of more than 1.15%.

Further, using the steel material of Table 1, the effect of a quenching temperature when quenching was performed multiple times was investigated.

A method for producing a thick-wall oil-well steel pipe according to the present embodiment includes the steps of: producing a steel pipe having the above described chemical composition, subjecting the steel pipe to quenching once or multiple times, wherein a quenching temperature in the quenching of at least once is 925 to 1100° C., and subjecting the steel pipe to tempering after the quenching.

Hereinafter, the thick-wall oil-well steel pipe according to the present embodiment and the production method thereof will be described in detail. Regarding chemical composition, "%" means "mass %."

[Chemical Composition]

The chemical composition of a low-alloy oil-well steel pipe according to the present embodiment contains the following elements.

C: 0.40 to 0.65%

The carbon (C) content of a low-alloy oil-well steel pipe according to the present embodiment is higher than those of conventional low-alloy oil-well steel pipes. C improves hardenability and increases strength of steel. A higher C content further facilitates spheroidizing of carbides during tempering, thereby improving SSC resistance. Further, C combines with Mo or V to form carbides, thereby improving temper softening resistance. Dispersion of carbides will result in further increase in strength of steel. If the C content is too low, these effects cannot be obtained. On the other hand, if the C content is too high, the toughness of steel deteriorates so that quench cracking becomes more likely to occur. Therefore, the C content is 0.40 to 0.65%. The lower limit of the C content is preferably 0.45%, more preferably 0.48%, and further more preferably 0.51%. The upper limit of C content is preferably 0.60%, and more preferably 0.57%.

Si: 0.05 to 0.50%

Silicon (Si) deoxidizes steel. If the Si content is too low, this effect cannot be obtained. On the other hand, if the Si content is too high, SSC resistance will deteriorate. Therefore, the Si content is 0.05 to 0.50%. The lower limit of the Si content is preferably 0.10%, and more preferably 0.15%. The upper limit of the Si content is preferably 0.40%, and more preferably 0.35%.

Mn: 0.10 to 1.0%

Manganese (Mn) deoxidizes steel. Further, Mn improves hardenability of steel. If the Mn content is too low, these effects cannot be obtained. On the other hand, if the Mn content is too high, Mn, along with impurity elements such as phosphorus (P) and sulfur (S), segregates at grain boundaries. In this case, the SSC resistance and toughness of steel will deteriorate. Therefore, the Mn content is 0.10 to 1.0%. The lower limit of the Mn content is preferably 0.20%, and more preferably 0.30%. The upper limit of the Mn content is preferably 0.80%, and more preferably 0.60%.

P: 0.020% or Less

Phosphorous (P) is an impurity. P segregates at grain boundaries, thereby deteriorating the SSC resistance of steel. Therefore, the P content is 0.020% or less. The P content is preferably 0.015% or less, and more preferably 0.012% or less. The P content is preferably as low as possible.

S: 0.0020% or Less

Sulfur (S) is an impurity. S segregates at grain boundaries, thereby deteriorating the SSC resistance of steel. Therefore, the S content is 0.0020% or less. The S content is preferably 0.0015% or less, and more preferably 0.0010% or less. The S content is preferably as low as possible.

Sol. Al: 0.005 to 0.10%

Aluminum (Al) deoxidizes steel. If the Al content is too low, this effect cannot be obtained and the SSC resistance of steel deteriorates. On the other hand, if the Al content is too high, oxides are formed, thereby deteriorating the SSC resistance of steel. Therefore, the Al content is 0.005 to 0.10%. The lower limit of the Al content is preferably 0.010%, and more preferably 0.015%. The upper limit of the Al content is preferably 0.08%, and more preferably 0.05%. The term "Al" content as used herein means the content of "acid-soluble Al," that is "sol. Al."

Cr: More than 0.40 to 2.0%

Chromium (Cr) improves hardenability of steel and increases its strength. If the Cr content is too low, the aforementioned effect cannot be obtained. On the other hand, if the Cr content is too high, the toughness and SSC resistance of steel will deteriorate. Therefore, the Cr content is more than 0.40 to 2.0%. The lower limit of the Cr content is preferably 0.48%, more preferably 0.50%, and further more preferably 0.51%. The upper limit of the Cr content is preferably 1.25%, and more preferably 1.15%.

Mo: More than 1.15 to 5.0%

Molybdenum (Mo) significantly improves hardenability when the quenching temperature is 925° C. or more. Further, Mo produces fine carbides, thereby improving temper softening resistance of steel. As a result, Mo contributes to the improvement of SSC resistance through high temperature tempering. If the Mo content is too low, this effect cannot be obtained. On the other hand, if the Mo content is too high, the aforementioned effect will be saturated. Therefore, the Mo content is more than 1.15 to 5.0%. The lower limit of the Mo content is preferably 1.20%, and more preferably 1.25%. The upper limit of the Mo content is preferably 4.2%, and more preferably 3.5%.

Cu: 0.50% or Less

Copper (Cu) is an impurity. Cu deteriorates SSC resistance. Therefore, the Cu content is 0.50% or less. The Cu content is preferably 0.10% or less, and more preferably 0.02% or less.

Ni: 0.50% or Less

Nickel (Ni) is an impurity. Ni deteriorates SSC resistance. Therefore, the Ni content is 0.50% or less. The Ni content is preferably 0.10% or less, and more preferably 0.02% or less.

N: 0.007% or Less

Nitrogen (N) is an impurity. N forms nitrides, thereby destabilizing the SSC resistance of steel. Therefore, the N content is 0.007% or less. The N content is preferably 0.005% or less. The N content is preferably as low as possible.

O: 0.005% or Less

Oxygen (O) is an impurity. O produces coarse oxides, thereby deteriorating the SSC resistance of steel. Therefore, the O content is 0.005% or less. The O content is preferably 0.002% or less. The O content is preferably as low as possible.

The balance of the chemical composition of the thick-wall oil-well steel pipe of the present embodiment consists of Fe and impurities. Impurities as used herein refer to elements which are mixed in from ores and scraps which are used as the raw material of steel, or from environments of the production process, etc.

The chemical composition of the thick-wall oil-well steel pipe of the present embodiment may further contain one or more kinds selected from the group consisting of V, Nb, Ti, Zr, and W in place of a part of Fe.

V: 0 to 0.25%

Vanadium (V) is an optional element, and may not be contained. If contained, V forms carbides, thereby improving the temper softening resistance of steel. As a result, V contributes to the improvement of SSC resistance through high temperature tempering. However, if the V content is too high, the toughness of steel deteriorates. Therefore, the V content is 0 to 0.25%. The lower limit of the V content is preferably 0.07%. The upper limit of the V content is preferably 0.20%, and more preferably 0.15%.

Nb: 0 to 0.10%

Niobium (Nb) is an optional element, and may not be contained. If contained, Nb combines with C and/or N to form carbides, nitrides, or carbonitrides. These precipitates (carbides, nitrides, and carbonitrides) refine the sub-structure of steel through a pinning effect, thereby improving the SSC resistance of steel. However, if the Nb content is too high, nitrides are excessively produced, thereby destabilizing the SSC resistance of steel. Therefore, the Nb content is 0 to 0.10%. The lower limit of the Nb content is preferably 0.010/0, and more preferably 0.013%. The upper limit of the Nb content is preferably 0.07%, and more preferably 0.04%.

Ti: 0 to 0.05%

Titanium (Ti) is an optional element, and may not be contained. If contained, Ti forms nitrides, and refines crystal grains through a pinning effect. However, if the Ti content is too high, Ti nitrides become coarser, thereby deteriorating the SSC resistance of steel. Therefore, the Ti content is 0 to 0.05%. The lower limit of the Ti content is preferably 0.005%, and more preferably 0.008%. The upper limit of the Ti content is preferably 0.02%, and more preferably 0.015%.

Zr: 0 to 0.10%

Zirconium (Zr) is an optional element, and may not be contained. As in the case of Ti, Zr forms nitrides, and refines crystal grains through a pinning effect. However, if the Zr content is too high, Zr nitrides become coarser, thereby deteriorating the SSC resistance of steel. Therefore, the Zr content is 0 to 0.10%. The lower limit of the Zr content is preferably 0.005%, and more preferably 0.008%. The upper limit of the Zr content is preferably 0.02%, and more preferably 0.015%.

W: 0 to 1.5%

Tungsten (W) is an optional element, and may not be contained. If contained, W forms carbides, thereby improving the temper softening resistance of steel. As a result, W contributes to the improvement of SSC resistance through high temperature tempering. Further, as in the case of Mo, W improves hardenability of steel, and particularly, significantly improves hardenability when the quenching temperature is 925° C. or more. Thus, W supplements the effect of Mo. However, if the W content is too high, its effect will be saturated. Further, W is expensive. Therefore, the W content is 0 to 1.5%. The lower limit of the W content is preferably 0.05%, and more preferably 0.1%. The upper limit of the W content is preferably 1.3%, and more preferably 1.0%.

The thick-wall oil-well steel pipe according to the present embodiment may further contain B in place of a part of Fe.

B: 0 to 0.005%

Boron (B) is an optional element, and may not be contained. If contained, B improves hardenability. This effect appears even if a small amount of B which is not immobilized by N exists in steel. However, if the B content is too high, $M_{23}(CB)_6$ is formed at grain boundaries, thereby deteriorating the SSC resistance of steel. Therefore, the B content is 0 to 0.005%. The lower limit of the B content is preferably 0.0005%. The upper limit of the B content is preferably 0.003%, and more preferably 0.002%.

The chemical composition of the thick-wall oil-well steel pipe according to the present embodiment may further contain one or more kinds selected from the group consisting of Ca, Mg, and rare earth metal (REM) in place of a part of Fe. Any of these elements improves the shape of sulfide, thereby improving the SSC resistance of steel.

Ca: 0 to 0.003%

Mg: 0 to 0.003%

Rare Earth Metal (REM): 0 to 0.003%

Calcium (Ca), Magnesium (Mg), and Rare Earth Metal (REM) are all optional elements, and may not be contained. If contained, these elements combine with S in steel to form sulfides. As a result of this, the shapes of sulfides are improved, thus improving the SSC resistance of steel.

Further, REM combines with P in steel, and suppresses the segregation of P at grain boundaries. As a result, deterioration of the SSC resistance of steel attributable to the segregation of P will be suppressed.

However, if the contents of these elements are too high, not only are these effects saturated, but also inclusions increase. Therefore, the Ca content is 0 to 0.003%, the Mg content is 0 to 0.003%, and REM is 0 to 0.003%. The lower limit of the Ca content is preferably 0.0005%. The lower limit of the Mg content is preferably 0.0005%. The lower limit of the REM content is preferably 0.0005%.

The term REM as used herein is a general term including 15 elements of lanthanoide series, and Sc and Y. The expression, REM is contained, means that one or more kinds of these elements are contained. The REM content means a total content of these elements.

[Coarse Carbides in Steel and Yield Strength]

In the steel of a thick-wall oil-well steel pipe according to the present embodiment, the number of carbide which has a circle equivalent diameter of 100 nm or more and contains 20 mass % or more of Mo is 2 or less per 100 $\mu m^2$. Hereinafter, a carbide having a circle equivalent diameter of 100 nm or more is referred to as a "coarse carbide." A carbide containing 20 mass % or more of Mo is referred to as a "Mo carbide." Here, the content of Mo in a carbide refers to a Mo content with the total amount of metal elements being 100 mass %. The total amount of metal elements excludes carbon (C) and nitrogen (N). A Mo carbide having a circle equivalent diameter of 100 nm or more is referred to as a "coarse Mo carbide." The circle equivalent diameter means a diameter of the circle which is obtained by converting the area of the above described carbide into a circle having the same area.

As described above, in a thick-wall oil-well steel pipe of the present embodiment, as a result of performing "high temperature quenching" in which the quenching temperature is 925° C. or more, the number of undissolved coarse Mo carbide is decreased and more Mo and C dissolve into steel. As a result of that, Mo and C improve hardenability, and thus high strength can be obtained. Further, by increasing the dissolved amount of Mo and C, the variation in strength in the wall-thickness direction is reduced. If the number N of coarse Mo carbide is 2 or less per 100 $\mu m^2$, the yield strength will become 827 MPa or more, and the difference between a maximum value and a minimum value of yield strength in the wall-thickness direction (hereinafter, referred to as yield strength difference $\Delta YS$) will become 45 MPa or less in a thick-wall oil-well steel pipe having a wall thickness of 40 mm or more.

The number of coarse Mo carbide is measured by the following method. A sample for microstructure observation is sampled from any position in a wall-thickness central portion. A replica film is sampled for the sample. The sampling of the replica film can be performed at the following conditions. First, an observation face of the sample is subjected to mirror polishing. Next, the polished observation face is eroded by soaking in a 3% Nital for 10 seconds at normal temperature. After that, carbon shadowing is performed to form replica film on the observation face. The sample of which the replica film is formed on the surface is soaked in a 5% Nital for 10 seconds at normal temperature to separate the replica film from the sample by eroding an interface between the replica film and the sample. After being washed in ethanol solution, the replica film is skimmed from the ethanol solution with sheet mesh. The replica film is dried and observed. Using a transmission type electron microscope (TEM) of a magnification of 10000, photographic images of 10 visual fields are produced. The area of each visual field is made 10 $\mu m \times 10\ \mu m = 100\ \mu m^2$.

In each visual field, a Mo carbide among carbides is determined. Specifically, Energy Dispersive X-ray Spectroscopy (EDX) is performed for the carbides in each visual field. From this result, the content of each metal element (including Mo) in carbides is measured. Among the carbides, one containing 20 mass % or more of Mo, with the total amount of metal elements being 100% is regarded as a Mo carbide. The total amount of metal elements excludes C and N.

A circle equivalent diameter of each determined Mo carbide is measured. A general-purpose image processing application (ImageJ 1.47v) is used for the measurement. A Mo carbide whose measured circle equivalent diameter is 100 nm or more is determined as a coarse Mo carbide.

The number of coarse Mo carbide in each visual field is counted. An average number of coarse Mo carbide in 10 visual fields is defined as a coarse Mo-carbide number N (per 100 $\mu m^2$).

Note that yield strength and yield strength difference ΔYS are measured by the following method. A round bar tensile test specimen having a diameter of 6 mm and a parallel portion of 40 mm length is fabricated in a position of a 6 mm depth from the outer surface (an outer surface first position), a wall-thickness central position, and a position of a 6 mm depth from the inner surface (an inner surface first position) of a section normal to the axial direction of the oil-well steel pipe. The longitudinal direction of the specimen is parallel with the axial direction of the steel pipe. With use of the specimen, tension test is performed at a normal temperature (25° C.) in the atmospheric pressure to obtain yield strength YS at each position. In a thick-wall oil-well steel pipe of the present embodiment, the yield strength YS is 827 MPa or more at any position, as described above. Further, the difference between the maximum value and the minimum value of yield strength YS at the above described three positions is defined as yield strength difference ΔYS (MPa). In a thick-wall oil-well steel pipe according to the present embodiment, the yield strength difference ΔYS is 45 MPa or less, as described above.

Note that the upper limit of the yield strength is not particularly limited. However, in the case of the above described chemical composition, the upper limit of the yield strength is preferably 930 MPa.

[Production Method]

An example of production method of the above described thick-wall oil-well steel pipe will be described. In this example, description will be made on a production method of a seamless steel pipe. The production method of a seamless steel pipe includes a pipe-making step, a quenching step, and a tempering step.

[Pipe-Making Step]

Steel having the above described chemical composition is melted and refined in a well-known method. Next, molten steel is formed into a continuously cast material by a continuous casting process. Examples of the continuously cast material include a slab, a bloom, and a billet. Alternatively, molten steel may be formed into an ingot by an ingot-making process.

A slab, a bloom, or an ingot is subjected to hot working to form a round billet. A round billet may be formed by hot rolling or hot forging.

The billet is subjected to hot working to produce a hollow shell. First, the billet is heated in a heating furnace. The billet withdrawn from the heating furnace is subjected to hot working to produce a hollow shell (seamless steel pipe). For example, a Mannesmann process is performed as the hot working to produce a hollow shell. In this case, a round billet is piercing-rolled by a piercing machine. The piercing-rolled round billet is further hot rolled by a mandrel mill, a reducer, and a sizing mill, etc. to form a hollow shell. The hollow shell may be produced from a billet by another hot working method. For example, in the case of a short thick-wall oil-well steel pipe such as a coupling, the hollow shell may be produced by forging.

By the above described steps, a steel pipe having a wall thickness of 40 mm or more is produced. Although the upper limit of the wall thickness is not particularly limited, it is preferably 65 mm or less in the viewpoint of the control of a cooling rate in the quenching step described later. The outer diameter of the steel pipe is not particularly limited. The outer diameter of the steel pipe is, for example, 250 to 500 mm.

The steel pipe produced by hot working may be air cooled (as-rolled). The steel pipe produced by hot working may also be subjected to direct quenching after hot pipe-making without being cooled to a normal temperature, or may be subjected to quenching after supplementary heating (reheating) is performed after hot pipe-making. However, when performing direct quenching or quenching after supplementary heating (so-called in-line quenching), it is preferable that cooling be stopped in the midway of quenching, or slow cooling be performed for the purpose of suppressing quench cracking.

When direct quenching is performed after hot pipe-making, or quenching is performed after performing supplementary heating after hot pipe-making, it is preferable that stress removing annealing (SR treatment) be performed after quenching and before heat treatment in the next step for the purpose of removing of residual stress. Hereinafter, quenching step will be described in detail.

[Quenching Step]

The hollow shell after hot working is subjected to quenching. Quenching may be performed multiple times. However, high temperature quenching (quenching at a quenching temperature of 925 to 1100° C.) shown next is performed at least once.

In the high temperature quenching, soaking is performed with the quenching temperature being 925 to 1100° C. If the quenching temperature is less than 925° C., an undissolved Mo carbide will not dissolve sufficiently. As a result, the number N of coarse Mo carbide becomes more than 2 per 100 $\mu m^2$. In such a case, the yield strength of a thick-wall oil-well steel pipe may become less than 827 MPa, and the yield strength difference ΔYS in the wall-thickness direction may exceed 45 MPa. On the other hand, when the quenching temperature exceeds 1100° C., the SSC resistance deteriorates since γ grains become significantly coarse. If the quenching temperature in the high temperature quenching is 925 to 1100° C., a Mo carbide dissolves sufficiently, and the number N of coarse Mo carbide will become 2 or less per 100 $\mu m^2$. As a result, hardenability is significantly improved. As a result, the yield strength of a thick-wall oil-well steel pipe after tempering will become 827 MPa or more, and the yield strength difference ΔYS in the wall-thickness direction will become 45 MPa or less. The lower limit of the quenching temperature in the high temperature quenching is preferably 930° C., more preferably 940° C., and further preferably 950° C. The upper limit of the quenching temperature is preferably 1050° C.

The soaking time in the high temperature quenching is preferably 15 minutes or more. If the soaking time is 15 minutes or more, a Mo carbide becomes more likely to dissolve. The lower limit of the soaking time is preferably 20 minutes. The upper limit of the soaking time is preferably 90 minutes. Even when the heating temperature is 1000° C. or more, if the soaking time is 90 minutes or less, coarsening of γ grains is suppressed and SSC resistance is further improved. However, even if the soaking time exceeds 90 minutes, a certain level of SSC resistance can be obtained.

When quenching is performed multiple times, the first quenching is preferably a high temperature quenching. In this case, a Mo carbide dissolves sufficiently by the first high temperature quenching. As a result, even if the quenching temperature in quenching of the following stage is a low temperature less than 925° C., high hardenability can be obtained. As a result, it is possible to further increase the yield strength.

Further, in the cooling in the final quenching when performing quenching once or multiple times, it is preferable that the cooling rate be 0.5 to 5° C./sec in a temperature range of 500 to 100° C. at a position where the cooling rate becomes minimum (hereinafter, referred to as a slowest cooling point) among positions in the wall-thickness direction. When the above described cooling rate is less than 0.5° C./sec, the proportion of martensite is likely to become deficient. On the other hand, when the above described cooling rate is more than 5° C./sec, quench cracking may occur. When the above described cooling rate is 0.5 to 5° C./sec, the proportion of martensite in steel sufficiently increases, resulting in increase in the yield strength. The cooling means is not particularly limited. For example, mist water cooling may be performed for the outer surface or both the outer and inner surfaces of the steel pipe, or the cooling may be performed by using a medium, which has lower heat transferring capability than that of water, such as oil or polymer.

Preferably, forced cooling at the above described cooling rate is started before the temperature at the slowest cooling position of the steel material becomes 600° C. or less. In this case, the yield strength is more likely to be increased.

[Hardness (HRC) after Quenching and Before Tempering]

When the above described thick-wall oil-well steel pipe is a coupling, as specified by API Specification 5CT, the Rockwell hardness (HRC) of the steel pipe after quenching and before tempering (that is, as quenched material) is preferably not less than HRCmin specified by Formula (1) in the whole area of the steel pipe.

$$HRC\ \text{min}=58\times C+27 \quad (1)$$

where "C" in Formula (1) is substituted by a C content (mass %).

If the cooling rate in a range of 500 to 100° C. at the above described slowest cooling position is less than 0.5° C./sec, Rockwell hardness (HRC) will become less than HRCmin of Formula (1). If the cooling rate is 0.5 to 5° C./sec, Rockwell hardness (HRC) will become not less than HRCmin specified by Formula (1). The lower limit of the above described cooling rate is preferably 1.2° C./sec. The upper limit of the above described cooling rate is preferably 4.0° C./sec.

As described above, quenching may be performed two or more times. In this case, quenching of at least once may be high temperature quenching. When quenching is performed multiple times, as described above, it is preferable to perform SR treatment after quenching and before performing quenching in the next stage for the purpose of removing residual stress generated by quenching.

When the SR treatment is performed, the treatment temperature is 600° C. or less. It is possible to prevent occurrence of delayed cracking after quenching by the SR treatment. If the treatment temperature exceeds 600° C., prior-austenite grains after final quenching may become coarse.

[Tempering Step]

Tempering is performed after the above described quenching is performed. The tempering temperature is 650° C. to Act point. If the tempering temperature is less than 650° C., spheroidizing of carbides will become insufficient, and SSC resistance will deteriorate. The lower limit of the tempering temperature is preferably 660° C. The upper limit of the tempering temperature is preferably 700° C. The soaking time of the tempering temperature is preferably 15 to 120 minutes.

Examples

Molten steel weighing 180 kg and having the chemical compositions shown in Table 3 was produced.

TABLE 3

| | Chemical composition (in mass %, and the balance being Fe and impurities) | | | | | | | | | | | | | | | | Others |
|---|---|---|---|---|---|---|---|---|---|---|---|---|---|---|---|---|---|
| Mark | C | Si | Mn | P | S | sol-Al | Cr | Mo | Cu | Ni | N | O | V | Nb | Ti | Ca | — |
| A | 0.51 | 0.24 | 0.44 | 0.009 | 0.0009 | 0.031 | 0.51 | 1.20 | 0.02 | 0.02 | 0.0046 | 0.0013 | 0.10 | — | 0.005 | 0.0002 | — |
| B | 0.50 | 0.24 | 0.44 | 0.008 | 0.0008 | 0.031 | 1.02 | 1.50 | 0.02 | 0.02 | 0.0045 | 0.0014 | 0.10 | — | 0.008 | 0.0003 | — |
| C | 0.51 | 0.24 | 0.31 | 0.010 | 0.0011 | 0.031 | 0.51 | 2.02 | — | — | 0.0047 | 0.0008 | — | 0.030 | 0.006 | 0.0010 | — |
| D | 0.51 | 0.24 | 0.31 | 0.011 | 0.0010 | 0.030 | 0.52 | 2.01 | — | — | 0.0051 | 0.0009 | 0.10 | 0.030 | 0.006 | 0.0014 | — |
| E | 0.52 | 0.24 | 0.29 | 0.012 | 0.0009 | 0.032 | 1.01 | 1.49 | — | — | 0.0048 | 0.0009 | 0.10 | 0.030 | 0.006 | 0.0005 | — |
| F | 0.61 | 0.19 | 0.44 | 0.010 | 0.0007 | 0.033 | 1.02 | 1.20 | — | — | 0.0039 | 0.0010 | 0.10 | 0.013 | 0.009 | 0.0003 | — |
| G | 0.49 | 0.20 | 0.45 | 0.008 | 0.0010 | 0.021 | 0.65 | 3.50 | — | — | 0.0025 | 0.0007 | 0.06 | 0.027 | 0.005 | 0.0004 | — |
| H | 0.52 | 0.31 | 0.62 | 0.007 | 0.0007 | 0.034 | 0.63 | 1.76 | 0.01 | 0.02 | 0.0033 | 0.0012 | — | — | — | — | — |
| I | 0.55 | 0.22 | 0.28 | 0.009 | 0.0011 | 0.043 | 0.61 | 1.55 | 0.01 | 0.02 | 0.0029 | 0.0007 | — | — | — | — | B 0.0015 |
| J | 0.53 | 0.19 | 0.42 | 0.010 | 0.0012 | 0.038 | 0.64 | 1.25 | 0.01 | 0.02 | 0.0030 | 0.0011 | — | — | — | — | W 0.5 |
| K | 0.56 | 0.33 | 0.35 | 0.007 | 0.0013 | 0.040 | 0.55 | 1.59 | 0.02 | 0.01 | 0.0035 | 0.0009 | — | — | — | — | Zr 0.0021 |

Molten steel of each mark was used to produce an ingot. The ingot was hot rolled to produce a steel plate supposing the use for a thick-wall oil-well steel pipe. The plate thickness (corresponding to wall thickness) of the steel plate of each Test number was as shown in Table 4.

TABLE 4

| Test number | Mark | Plate thickness | Heat treatment | As-quenched hardness (HRC) Outer surface second position | Wall-thickness central position | Inner surface second position | HRCmin |
|---|---|---|---|---|---|---|---|
| 1 | A | 40 min | 950° C. 30 minutes Mist Q (Cooling rate 3° C./s) | 57.8 | 58.6 | 58.3 | 56.6 |
| 2 | A | 53 mm | 950° C. 30 minutes Mist Q + 580° C. 10 minutes SR + 900° C. 30 minutes Mist Q (Cooling rate 2° C./s) | 57 | 57.5 | 56.9 | 56.6 |
| 3 | B | 40 min | 950° C. 30 minutes Mist Q (Cooling rate 3° C./s) | 56.9 | 57 | 56.6 | 56.0 |
| 4 | B | 53 mm | 950° C. 30 minutes Mist Q + 580° C. 10 minutes SR + 900° C. 30 minutes Mist Q (Cooling rate 2° C./s) | 57.4 | 58.9 | 58.1 | 56.0 |
| 5 | C | 40 mm | 950° C. 30 minutes Mist Q + 600° C. 15 minutes SR + 900° C. 30 minutes Mist Q (Cooling rate 3° C./s) | 57.3 | 58 | 57 | 56.6 |
| 6 | C | 53 mm | 970° C. 30 minutes Mist Q + 600° C. 15 minutes SR + 900° C. 30 minutes Mist Q (Cooling rate 2° C./s) | 58 | 59.8 | 57.3 | 56.6 |
| 7 | D | 40 mm | 980° C. 30 minutes Mist Q + 600° C. 15 minutes SR + 900° C. 30 minutes Mist Q (Cooling rate 2° C./s) | 59.1 | 59.2 | 57.5 | 56.6 |
| 8 | D | 53 mm | 1000° C. 30 minutes Mist Q + 600° C. 15 minutes SR + 900° C. 30 minutes Mist Q (Cooling rate 1.5° C./s) | 58.1 | 57.2 | 57.2 | 56.6 |
| 9 | E | 40 mm | 950° C. 30 minutes Mist Q + 600° C. 15 minutes SR + 900° C. 30 minutes Mist Q (Cooling rate 2° C./s) | 59.5 | 60 | 58 | 57.2 |
| 10 | E | 53 mm | 950° C. 30 minutes Mist Q + 600° C. 15 minutes SR + 900° C. 30 minutes Mist Q (Cooling rate 3° C./s) | 59.8 | 60.4 | 58.3 | 57.2 |
| 11 | F | 40 mm | 950° C. 30 minutes Mist Q + 600° C. 15 minutes SR + 900° C. 30 minutes Mist Q (Cooling rate 1.5° C./s) | 62.7 | 63.2 | 63.3 | 62.4 |
| 12 | F | 53 mm | 950° C. 30 minutes Mist Q + 600° C. 15 minutes SR + 900° C. 30 minutes Mist Q (Cooling rate 1.5° C./s) | 62.7 | 62.8 | 62.6 | 62.4 |
| 13 | G | 40 min | 1050° C. 30 minutes Mist Q (Cooling rate 2° C./s) | 60.1 | 59.6 | 60 | 55,4 |
| 14 | G | 53 mm | 1050° C. 30 minutes Mist Q + 550° C. 15 minutes SR + 960° C. 30 minutes Mist Q (Cooling rate 2° C./s) | 58.5 | 57.9 | 57.5 | 55.4 |
| 15 | C | 40 mm | 900° C. 30 minutes Mist Q (Cooling rate 3° C./s) | 60.5 | 51.5 | 52 | 56.6 |
| 16 | C | 53 mm | 900° C. 30 minutes Mist Q + 550° C. 15 minutes SR + 900° C 30 minutes Mist Q (Cooling rate 3° C./s) | 58.7 | 50.3 | 51.3 | 56.6 |
| 17 | H | 40 mm | 950° C. 30 minutes Mist Q (Cooling rate 3° C./s) | 59.1 | 58.5 | 58.3 | 57.2 |
| 18 | I | 45 mm | 950° C. 30 minutes Mist Q (Cooling rate 2.5° C./s) | 62.0 | 61.5 | 61.0 | 58.9 |
| 19 | J | 45 mm | 950° C. 30 minutes Mist Q (Cooling rate 2.5° C./s) | 59.1 | 58.5 | 58.3 | 57.7 |
| 20 | K | 53 mm | 950° C. 30 minutes Mist Q (Cooling rate 2° C./s) | 61.5 | 61.0 | 61.0 | 59.5 |

Heat treatment (quenching and SR treatment) was performed at heat treatment conditions shown in Table 4 for steel plates of each Test number after hot rolling. Referring to Table 4, it is indicated that in Test No. 1, quenching by mist cooling (mist Q) was performed once, the quenching temperature was 950° C., the soaking time was 30 minutes, and the cooling rate of the steel plate in a temperature range of 500 to 100° C. was 3° C./sec (denoted as "Cooling rate 3° C./sec" in Table 4).

It is indicated that in Test No. 2, quenching by mist cooling was performed in the quenching of the first time, in which the quenching temperature was 950° C., and the soaking time was 30 minutes. It is indicated that, thereafter, SR treatment (denoted by "SR" in Table 4) was performed, in which the heat treatment temperature was 580° C. and the soaking time was 10 minutes. It means that, thereafter, quenching by mist cooling of the second time was performed, in which the quenching temperature was 900° C., the soaking time was 30 minutes, and the cooling rate was 2° C./sec. Note that in the quenching by mist cooling, mist water was sprayed onto only one of the surfaces (2 surfaces) of the steel plate. Then, the surface onto which mist water had been sprayed was supposed to be the outer surface of the steel pipe, and the surface on the other side was supposed to be the inner surface of the steel pipe.

The cooling rates shown in Table 4 are each an average cooling rate in a range of 500 to 100° C. at the slowest cooling position of the steel plate of each Test number.

After the above described heat treatment was performed, tempering was performed. In tempering of each Test number, the tempering temperature was 680 to 720° C., and the soaking time was 10 to 120 minutes.

[Rockwell Hardiness Measurement Test after Quenching and Before Tempering]

Rockwell hardness was measured as shown below for the steel plate (as quenched material) of each Test number after the above described heat treatment (after the final quenching). Rockwell hardness (HRC) test conforming to JIS Z2245 (2011) was performed in a position of a 1.0 mm depth from the outer surface (the surface onto which mist water had been sprayed) (hereinafter referred to as an "outer surface second position"), a plate thickness central position corresponding to the wall-thickness center (wall-thickness central position), and a position of a 1.0 mm depth from the inner surface (the surface opposite to the surface onto which mist water had been sprayed) (hereinafter referred to as an "inner surface second position") of the steel plate. Specifically, Rockwell hardness (HRC) of arbitrary three locations was determined at each of the outer surface second position, the wall-thickness central position, and the inner surface second position, and an average thereof was defined as Rockwall hardness (HRC) of each position (the outer surface second position, the wall-thickness central position, and the inner surface second position).

[Measurement Test of Coarse Mo-Carbide Number N]

The coarse Mo-carbide number N (per 100 $\mu m^2$) was determined by the above described method for the steel plate of each Test number after tempering.

[Yield Strength (YS) and Tensile Strength (TS) Test]

A round bar tensile test specimen having a diameter of 6 mm and a parallel portion of 40 mm length was fabricated in a position of a 6.0 mm depth from the outer surface (the surface onto which mist water had been sprayed) (an outer surface first position), a wall-thickness central position, and a position of a 6.0 mm depth from the inner surface (the surface opposite to the surface onto which mist water had been sprayed) (an inner surface first position) of the steel plate of each Test number after tempering. The axial direction of the tensile test specimen was parallel with the rolling direction of the steel plate.

Using each round bar test specimen, tension test was performed at a normal temperature (25° C.) in the atmosphere to obtain yield strength YS (MPa) and tensile strength (TS) at each position. Further, yield strength difference ΔYS (MPa), which is the difference between a maximum value and a minimum value of yield strength YS (MPa) at each position, was determined.

[SSC Resistance Test]

A round bar tensile test specimen having a diameter of 6.3 mm and a parallel portion of 25.4 mm length was fabricated from the outer surface first position, the wall-thickness central position, and the inner surface first position of the steel plate of each Test number after tempering.

Using each test specimen, a constant-load type SSC resistance test conforming to A method of NACE-TMO 177 (2005 version) was performed. Specifically, the test specimen was immersed into NACE-A bath of 24° C. (partial pressure of $H_2S$ was 1 bar), and the immersed test specimen was subjected to a load corresponding to 90% of the yield strength obtained by the above described yield strength test. After elapse of 720 hours, whether or not cracking had occurred in the test specimen was observed. When no cracking was observed, it was determined that SSC resistance was excellent ("NF" in Table 5), and when cracking was observed, it was determined that SSC resistance was poor ("F" in Table 5).

[Test Results]

Table 5 shows test results.

TABLE 5

| Test number | Mark | Wall thickness | Coarse Mo-carbide number N (per 100 $\mu m^2$) | YS (MPa) Outer surface first position | YS (MPa) Wall-thickness central position | YS (MPa) Inner surface first position | ΔYS | TS (MPa) Outer surface first position | TS (MPa) Wall-thickness central position | TS (MPa) Inner surface first position | SSC resistance Outer surface first position | SSC resistance Wall-thickness central position | SSC resistance Inner surface first position |
|---|---|---|---|---|---|---|---|---|---|---|---|---|---|
| 1 | A | 40 mm | 1.3 | 890 | 885 | 880 | 10 | 977 | 975 | 970 | NF | NF | NF |
| 2 | A | 53 mm | 0.0 | 875 | 878 | 870 | 8 | 959 | 962 | 955 | NF | NF | NF |
| 3 | B | 40 mm | 1.6 | 922 | 920 | 920 | 2 | 986 | 982 | 985 | NF | NF | NF |
| 4 | B | 53 mm | 1.3 | 893 | 888 | 885 | 8 | 965 | 958 | 955 | NF | NF | NF |
| 5 | C | 40 mm | 1.0 | 894 | 884 | 869 | 25 | 954 | 942 | 937 | NF | NF | NF |
| 6 | C | 53 mm | 1.0 | 913 | 910 | 874 | 39 | 970 | 967 | 946 | NF | NF | NF |
| 7 | D | 40 min | 0.0 | 913 | 879 | 875 | 38 | 980 | 950 | 933 | NF | NF | NF |
| 8 | D | 53 min | 0.0 | 890 | 887 | 873 | 17 | 947 | 944 | 943 | NF | NF | NF |
| 9 | E | 40 mm | 1.2 | 968 | 965 | 965 | 3 | 1023 | 1016 | 1020 | NF | NF | NF |
| 10 | E | 53 mm | 1.8 | 898 | 873 | 879 | 25 | 947 | 946 | 950 | NF | NF | NF |
| 11 | F | 40 min | 1.0 | 885 | 900 | 873 | 27 | 975 | 976 | 952 | NF | NF | NF |
| 12 | F | 53 mm | 1.2 | 910 | 899 | 878 | 32 | 961 | 954 | 950 | NF | NF | NF |
| 13 | G | 40 mm | 1.0 | 906 | 907 | 905 | 2 | 964 | 975 | 964 | NF | NF | NF |
| 14 | G | 53 min | 1.5 | 912 | 912 | 911 | 1 | 973 | 971 | 973 | NF | NF | NF |
| 15 | C | 40 min | 4.5 | 894 | 854 | 826 | 68 | 954 | 959 | 958 | NF | F | F |
| 16 | C | 53 mm | 4.0 | 891 | 838 | 803 | 88 | 977 | 963 | 924 | NF | F | F |
| 17 | H | 40 min | 1.8 | 850 | 843 | 830 | 20 | 923 | 917 | 912 | NF | NF | NF |
| 18 | I | 45 mm | 1.9 | 875 | 863 | 850 | 25 | 940 | 948 | 943 | NF | NF | NF |

TABLE 5-continued

| Test number | Mark | Wall thickness | Coarse Mo-carbide number N (per 100 μm²) | YS (MPa) Outer surface first position | YS (MPa) Wall-thickness central position | YS (MPa) Inner surface first position | ΔYS | TS (MPa) Outer surface first position | TS (MPa) Wall-thickness central position | TS (MPa) Inner surface first position | SSC resistance Outer surface first position | SSC resistance Wall-thickness central position | SSC resistance Inner surface first position |
|---|---|---|---|---|---|---|---|---|---|---|---|---|---|
| 19 | J | 45 min | 0.5 | 911 | 900 | 890 | 21 | 969 | 967 | 970 | NF | NF | NF |
| 20 | K | 53 min | 1.5 | 888 | 862 | 854 | 34 | 975 | 947 | 938 | NF | NF | NF |

"ΔYS" in Table 5 shows yield strength difference of each Test number. Referring to Table 5, in Test numbers 1 to 14 and Test numbers 17 to 20, the chemical composition was appropriate, and also production conditions (quenching conditions) were appropriate. As a result, the coarse Mo-carbide number N for Test numbers 1 to 14 and Test numbers 17 to 20 was 2 or less per 100 μm². As a result, the yield strength was 827 MPa or more at any positions, and the yield strength difference ΔYS was 45 MPa or less. Further, in the SSC resistance test, no cracking was observed at any positions (outer face first position, wall-thickness central position, and inner surface first position), exhibiting excellent SSC resistance. Note that Rockwell hardness before tempering (HRC, see Table 4) for Test numbers 1 to 14 and Test numbers 17 to 20 was all more than HRCmin calculated from the above described Formula (1).

On the other hand, the chemical compositions of Test numbers 15 and 16 were both appropriate. However, the quenching temperatures in the quenching were both less than 925° C. As a result, the coarse Mo-carbide number N was 2 or more per 100 μm² for both Test numbers 15 and 16. As a result, the yield strength at the inner surface first position was less than 827 MPa. Further, the yield strength difference ΔYS exceeded 45 MPa. Furthermore, SSC was confirmed at the wall-thickness central position and the inner surface first position.

Embodiments of the present invention have been described. However, the above described embodiments are merely examples to practice the present invention. Therefore, the present invention will not be limited to the above described embodiments and can be practiced by appropriately modifying the above described embodiments within the range not departing from the spirit of the present invention.

The invention claimed is:

1. A thick-wall oil-well steel pipe having a wall thickness of 40 mm or more, and having a chemical composition consisting of, in mass %, C: 0.40 to 0.65%,
Si: 0.05 to 0.50%,
Mn: 0.10 to 1.0%,
P: 0.020% or less,
S: 0.0020% or less,
sol. Al: 0.005 to 0.10%,
Cr: more than 0.40 to 2.0%,
Mo: more than 1.15 to 5.0%,
Cu: 0.50% or less,
Ni: 0.50% or less,
N: 0.007% or less,
O: 0.005% or less,
V: 0 to 0.25%,
Nb: 0 to 0.10%,
Ti: 0 to 0.05%,
Zr: 0 to 0.10%,
W: 0 to 1.5%,
B: 0 to 0.005%,
Ca: 0 to 0.003%,
Mg: 0 to 0.003%, and
rare earth metal: 0 to 0.003%, with the balance being Fe and impurities, wherein
the number of carbide which has a circle equivalent diameter of 100 nm or more and contains 20 mass % or more of Mo is 2 or less per 100 μm², and wherein
the thick-wall oil-well steel pipe has yield strength of 827 MPa or more, and a difference between a maximum value and a minimum value of the yield strength in a wall-thickness direction is 45 MPa or less.

2. A method for producing a thick-wall oil-well steel pipe according to claim 1, comprising the steps of:

producing a steel pipe having the chemical composition consisting of, in mass %,
C: 0.40 to 0.65%,
Si: 0.05 to 0.50%,
Mn: 0.10 to 1.0%,
P: 0.020% or less,
S: 0.0020% or less,
sol. Al: 0.005 to 0.10%,
Cr: more than 0.40 to 2.0%,
Mo: more than 1.15 to 5.0%,
Cu: 0.50% or less,
Ni: 0.50% or less,
N: 0.007% or less,
O: 0.005% or less,
V: 0 to 0.25%,
Nb: 0 to 0.10%,
Ti: 0 to 0.05%,
Zr: 0 to 0.10%,
W: 0 to 1.5%,
B: 0 to 0.005%,
Ca: 0 to 0.003%,
Mg: 0 to 0.003%, and
rare earth metal: 0 to 0.003%, with the balance being Fe and impurities,
subjecting the steel pipe to quenching once or multiple times, wherein a quenching temperature in the quenching of at least once is 925 to 1100° C., and
subjecting the steel pipe to tempering after the quenching.

* * * * *